US009630081B2

(12) United States Patent
Gillespie

(10) Patent No.: US 9,630,081 B2
(45) Date of Patent: Apr. 25, 2017

(54) ELASTIC TRAINING APPARATUS

(71) Applicant: Bryce L. Gillespie, Beaverton, OR (US)

(72) Inventor: Bryce L. Gillespie, Beaverton, OR (US)

( * ) Notice: Subject to any disclaimer, the term of this patent is extended or adjusted under 35 U.S.C. 154(b) by 0 days.

(21) Appl. No.: 14/535,686

(22) Filed: Nov. 7, 2014

(65) Prior Publication Data

US 2016/0129294 A1 May 12, 2016

(51) Int. Cl.

| | |
|---|---|
| ***A63B 21/055*** | (2006.01) |
| ***A63B 71/00*** | (2006.01) |
| ***A63B 23/12*** | (2006.01) |
| ***A63B 21/00*** | (2006.01) |
| ***A63B 21/04*** | (2006.01) |
| *A63B 21/002* | (2006.01) |
| *A63B 71/02* | (2006.01) |

(52) U.S. Cl.

CPC .... *A63B 71/0054* (2013.01); *A63B 21/00043* (2013.01); *A63B 21/0442* (2013.01); *A63B 21/0552* (2013.01); *A63B 21/0555* (2013.01); *A63B 23/1245* (2013.01); *A63B 21/0023* (2013.01); *A63B 21/4013* (2015.10); *A63B 21/4035* (2015.10); *A63B 2071/009* (2013.01); *A63B 2071/026* (2013.01); *A63B 2208/0204* (2013.01); *A63B 2208/0252* (2013.01)

(58) Field of Classification Search

CPC ..... A63B 21/0552; A63B 21/4035; A63B 21/0557; A63B 21/0442; A63B 21/00043; A63B 21/4025; A63B 21/4015; A63B 21/0555; A63B 21/4011; A63B 2210/50; A63B 2023/006; A63B 21/068; A63B 21/4017; A63B 21/02; A63B 21/4013; A63B 23/03575; A63B 21/4019; A63B 21/4039; A63B 23/00; A63B 23/04; A63B 21/00; A63B 2208/0204; A63B 23/0211; A63B 23/0216; A63B 23/0227; A63B 23/08; A63B 23/085; A63B 23/10

USPC ..... 482/92, 121–122, 124–128, 131, 139; D21/662

See application file for complete search history.

(56) References Cited

U.S. PATENT DOCUMENTS

| | | | | |
|---|---|---|---|---|
| 1,677,728 A | | 7/1928 | Robinson | |
| 3,838,852 A | * | 10/1974 | Gury | A63B 21/0004 482/125 |
| 4,019,734 A | * | 4/1977 | Lee | A63B 21/0552 482/125 |
| 4,033,580 A | * | 7/1977 | Paris | A63B 21/0004 482/122 |

(Continued)

*Primary Examiner* — Andrew S Lo

(74) *Attorney, Agent, or Firm* — Plager Schack LLP

(57) ABSTRACT

An elastic resistance training apparatus for the performance of ankle plantar flexor resistance exercises, dorsi flexor resistance exercises, ankle inverter resistance exercises, or ankle everter exercises by a user. The apparatus comprises an elastic cord with a primary loop at each end configured to engage the dorsum and plantar surfaces of the user's foot. An auxiliary loop is connected to the primary loop and configured to engage the user's calcaneus bone when the primary loop engages the dorsum and plantar surfaces of the user's foot centering the apparatus at the talocrural joint to enable the user to perform talocrural joint movements without the apparatus disengaging from the user's foot during resistance exercises.

6 Claims, 3 Drawing Sheets

(56) References Cited

U.S. PATENT DOCUMENTS 4,042,241 A * 8/1977 Collins ..... A63B 69/0086 273/DIG. 17
4,121,827 A * 10/1978 Weider ..... A63B 21/0004 482/125
4,245,840 A * 1/1981 Van Housen ..... A63B 21/0004 24/115 H
4,251,071 A * 2/1981 Norton ..... A63B 21/0004 482/125
D275,588 S * 9/1984 Watanabe ..... D21/692
4,478,414 A * 10/1984 Molloy ..... A63B 21/1609 482/123
4,591,150 A * 5/1986 Mosher ..... A63B 21/0004 482/125
4,685,671 A * 8/1987 Hagerman ..... A63B 21/04 482/124
4,733,862 A * 3/1988 Miller ..... A63B 21/0552 24/129 R
4,852,874 A * 8/1989 Sleichter, III ..... A63B 21/0004 482/122
4,909,505 A * 3/1990 Tee ..... A63B 21/00043 482/121
5,100,129 A * 3/1992 Porter ..... A63B 21/0552 482/125
5,205,803 A * 4/1993 Zemitis ..... A63B 21/0552 482/121
5,318,494 A * 6/1994 Santighian ..... A63B 21/0004 482/121
5,352,174 A * 10/1994 Mason ..... A63B 21/0004 482/129
D368,501 S * 4/1996 Woodruff ..... D21/672
5,556,369 A * 9/1996 Roberts ..... A63B 21/4017 482/131
5,558,609 A * 9/1996 Olschansky ..... A63B 21/0552 482/122
5,688,213 A * 11/1997 Recker ..... A63B 21/0004 482/125
5,716,307 A * 2/1998 Vadher ..... A43B 7/20 482/124
5,813,954 A * 9/1998 Wilkinson ..... A63B 21/0004 482/124
5,857,945 A * 1/1999 Papp ..... A63B 21/0004 482/121
6,368,255 B1 * 4/2002 Chan-Rouse ..... A63B 23/00 482/126
6,884,202 B2 * 4/2005 Erwin ..... A63B 21/0004 482/121
7,032,529 B2 * 4/2006 Sanford ..... F16F 7/006 114/230.2
7,087,003 B1 * 8/2006 Katterjohn ..... A63B 21/0004 482/124
7,090,627 B1 * 8/2006 Walker ..... A63B 21/055 482/121
7,214,171 B2 * 5/2007 Thelen ..... A63B 21/055 482/121
7,223,212 B2 * 5/2007 DiOrio ..... A63B 21/0023 482/83
7,611,450 B2 * 11/2009 Mancini ..... A63B 21/04 482/123
7,785,244 B2 * 8/2010 Hetrick ..... A63B 21/4017 482/139
7,794,374 B1 * 9/2010 Park ..... A63B 21/0004 482/122
7,998,041 B1 * 8/2011 Johnson ..... A63B 21/0552 482/124
8,012,071 B2 * 9/2011 Grisdale ..... A63B 21/0004 482/122
8,454,484 B2 * 6/2013 Keen ..... A63B 21/02 224/218
D723,116 S * 2/2015 Gillespie ..... D21/662
8,944,976 B2 * 2/2015 Crowell ..... A63B 21/0442 482/121
9,017,235 B2 * 4/2015 Khademi ..... A63B 21/00043 482/121
D740,109 S * 10/2015 Cruz ..... D8/382
D741,419 S * 10/2015 Cohen ..... D21/662
2001/0034291 A1 * 10/2001 Horton ..... A63B 21/0552 482/124
2002/0187885 A1 * 12/2002 Liao ..... A63B 21/0552 482/126
2003/0195092 A1 * 10/2003 Basting ..... A63B 21/0552 482/124
2005/0079963 A1 * 4/2005 Lin ..... A63B 21/0004 482/126
2005/0192168 A1 * 9/2005 Wilcocks ..... A63B 21/0004 482/124
2005/0282689 A1 * 12/2005 Weinstein ..... A63B 21/0552 482/124
2006/0025290 A1 * 2/2006 House ..... A61H 3/00 482/124
2006/0063651 A1 * 3/2006 Sload ..... A63B 21/0004 482/124
2007/0232468 A1 * 10/2007 Levy ..... A63B 21/0004 482/121
2008/0009398 A1 * 1/2008 Grisdale ..... A63B 21/0004 482/124
2008/0058180 A1 * 3/2008 Clarke ..... A63B 21/0004 482/126
2008/0214369 A1 * 9/2008 Mancini ..... A63B 21/04 482/121
2009/0149303 A1 * 6/2009 Meisterling ..... A63B 21/0004 482/124
2009/0239723 A1 * 9/2009 Jovanovic ..... A63B 21/0023 482/131
2010/0041527 A1 * 2/2010 Miller ..... A63B 21/0552 482/124
2010/0216613 A1 * 8/2010 Pacini ..... A63B 21/0552 482/122
2010/0317495 A1 * 12/2010 Digiovanni ..... A63B 21/0552 482/129
2011/0306477 A1 * 12/2011 Keen ..... A63B 21/02 482/122
2013/0012368 A1 * 1/2013 Verruto ..... A63B 21/00185 482/124
2013/0040791 A1 * 2/2013 Bornstein ..... A63B 21/0442 482/124
2013/0231227 A1 * 9/2013 Ranieri ..... A63B 21/0421 482/124
2013/0303344 A1 * 11/2013 Rasnake ..... A63B 21/02 482/124
2014/0228183 A1 * 8/2014 Falconi ..... A63B 21/0557 482/122
2014/0342884 A1 * 11/2014 Aldridge ..... A61H 1/0237 482/131

* cited by examiner

ELASTIC TRAINING APPARATUS

BACKGROUND

The present invention relates to the fitness industry, therapeutic rehabilitation industry, and sports performance industry. The embodiments herein relate generally to an elastic resistance training apparatus for the performance of ankle plantar flexor exercises, dorsi flexor exercises, ankle inverter exercises, or ankle everter exercises by a user.

There are countless resistance training devices in the form of elastic resistance bands and elastic resistance tubing devices that are currently on the market. Many of these devices such as U.S. Pat. No. 6,884,202 B2 are attached to the user's body in various arrangements by using cuffs and/or come with removable resistances that can be altered or switched by using clips to allow the user to perform the exercises and or activity that is desired. Another such device, U.S. Pat. No. 7,087,003 B1, provides a device that slips over the toe box of the user's shoe to perform the desired exercise. Although there are many more products that are available in the market for elastic resistance training, many of these devices suffer from the defect of being easily dislodged or disengaged from the user resulting in ineffective workouts.

Resistance exercise tubing and elastic bands are well known for their use in therapeutic rehabilitation and fitness training. These devices are typically applied at the distal femur and/or the distal tibia of both legs to provide resistance training to the hip musculature which includes hip flexors, hip extensors, hip internal rotators, hip external rotators, hip adductors and hip abductors whether it be for therapeutic rehabilitation and/or fitness training. The resistance for many of the products is created by the movement of limbs in opposite directions. This creates tension of the elastic resistance tubing and elastic band.

A recognized problem with the prior art devices is the inadvertent sliding and movement of the devices during use. The prior art devices frequently move up and down the leg or slide off the foot when in use which results in decreased performance and results.

It is an object of the present invention to provide users with a resistance training device that stays in place during multiple forms of exercise and resistance training.

A further object of the present invention is to allow the user the ability to improve fitness in regards to progressive resistance training, flexibility, balance, coordination, muscle endurance and muscle strength.

A further object of the present invention is to provide the user the ability to perform functional movements while using the present invention.

SUMMARY

An elastic resistance training apparatus for the performance of ankle plantar flexor resistance exercises, dorsi flexor resistance exercises, ankle inverter resistance exercises, or ankle everter exercises by a user. The apparatus comprises an elastic cord with a primary loop at each end configured to engage the dorsum and plantar surfaces of the user's foot. An auxiliary loop is connected to the primary loop and configured to engage the user's calcaneus bone when the primary loop engages the dorsum and plantar surfaces of the user's foot centering the apparatus at the talocrural joint to enable the user to perform talocrural joint movements without the apparatus disengaging from the user's foot during resistance exercises. The elastic cord is surrounded by a fabric of greater elasticity to protect the user in the event the elastic cord snaps during use. the elastic cord is selected from the group comprising polyvinyl chloride tubing, thermoplastic polyurethane tubing, bungee cord.

BRIEF DESCRIPTION OF THE FIGURES

The detailed description of some embodiments of the invention will be is made below with reference to the accompanying figures, wherein like numerals represent corresponding parts of the figures.

DETAILED DESCRIPTION OF CERTAIN EMBODIMENTS

Figure 1:
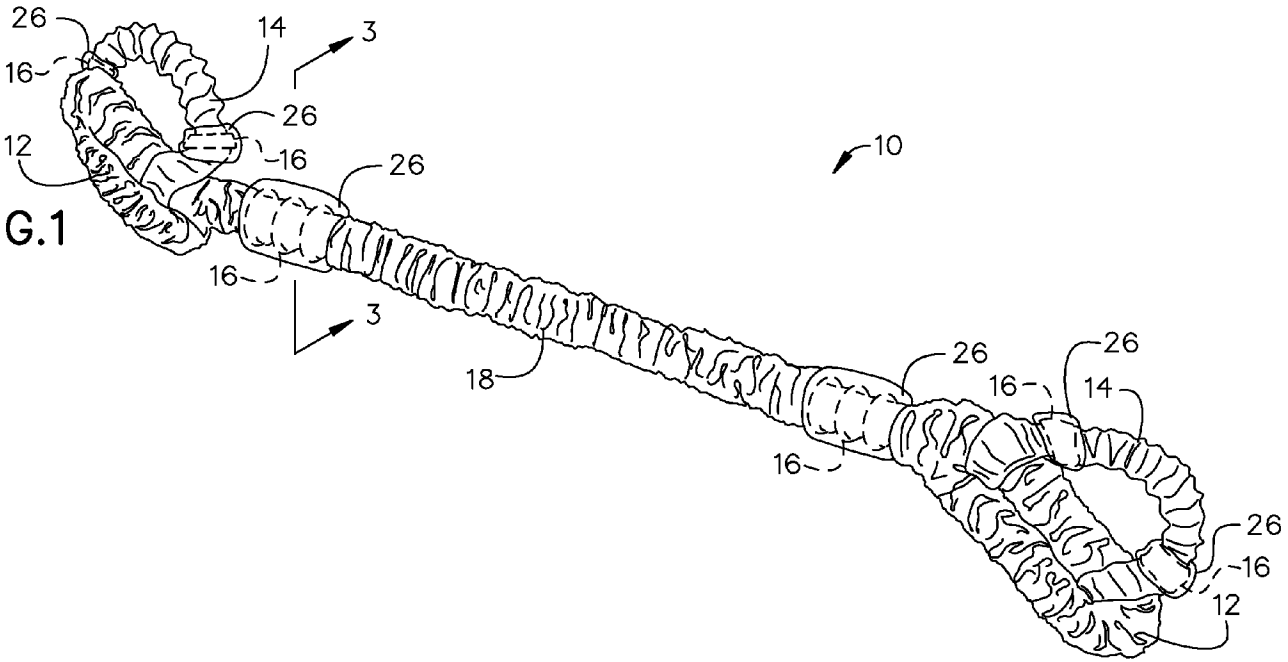
FIG. 1 shows a schematic perspective view of one embodiment of the present invention.
Figure 2:
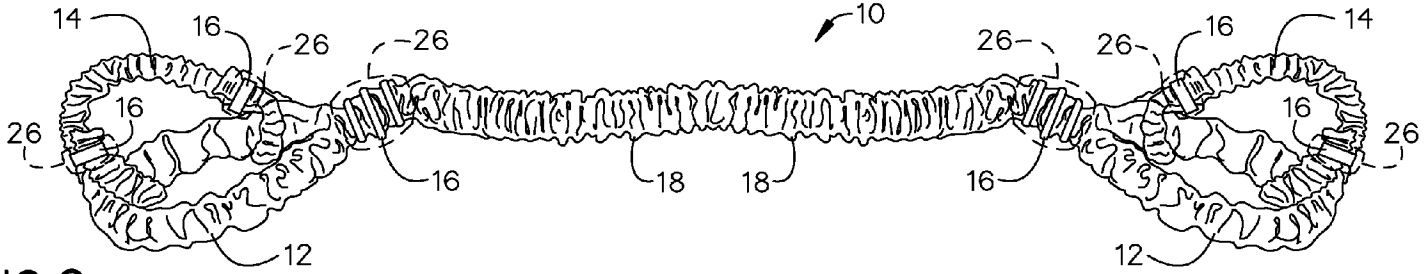
FIG. 2 shows a front view of one embodiment of the invention.
Figures 3, 4:
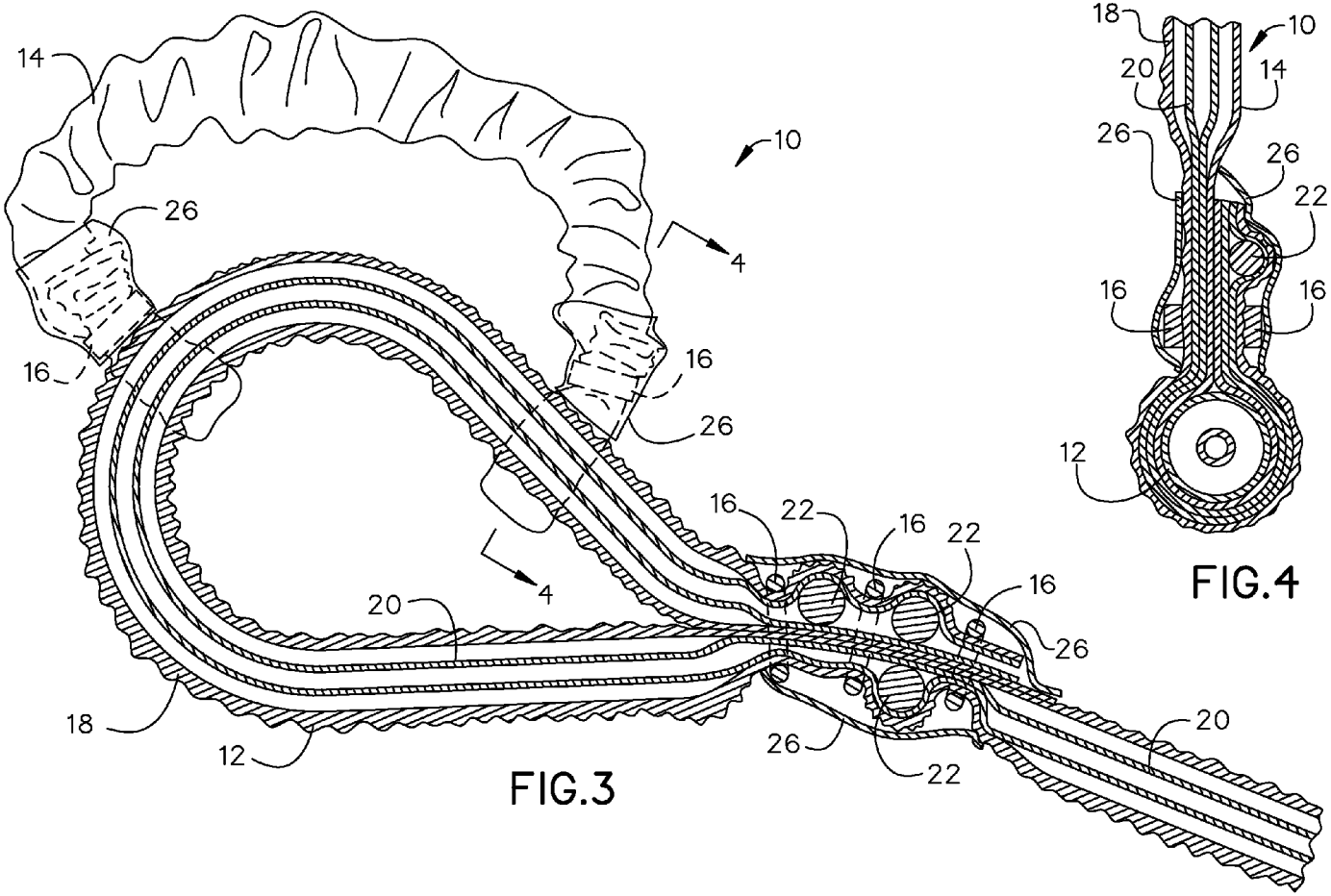
FIG. 3 is a section detail view of one embodiment of the invention along line 3-3 in FIG. 1.
FIG. 4 is a section detail view of one embodiment of the invention along line 4-4 in FIG. 3.

By way of example, and referring to FIGS. 1 through 7, one embodiment of the present apparatus 10 comprises an elastic cord 20 with a first end and second end forming a primary loop 12 at each end. Primary loop 12 is configured to engage the dorsum and plantar surfaces of a user's 24 foot. The primary loop 12 may be formed using mechanical means such as clamps 16 or other means readily known to persons of ordinary skill in the art. It is preferred that when clamps 16 are used to form the primary loop 12 that spacers 22 are placed between each clamp 16 as depicted in FIG. 3.

Figure 5:
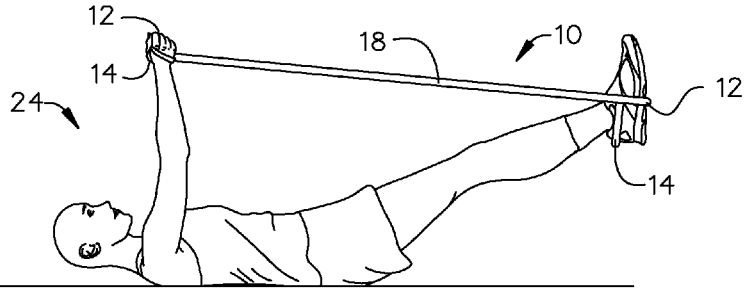
FIG. 5 is a side view of one embodiment of the invention in exemplary usage.
Figure 7:
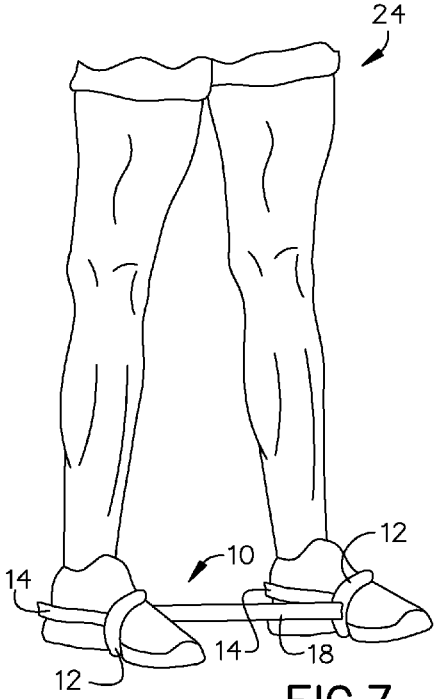
FIG. 7 is a detail perspective view of the invention shown in exemplary usage.

An auxiliary loop 14 is connected to primary loop 12 as depicted in FIGS. 3 and 4 using mechanical means such as clamps 16 or other means readily known to persons of ordinary skill in the art. It is preferred that when clamps 16 are used to connect the auxiliary loop 14 to the primary loop 12 that spacers 22 are placed between each clamp 16 as depicted in FIG. 3. Clamps 16 can be covered with covering 26. The auxiliary loop 14 is configured to engage the calcaneus bone of the user 24 when primary loop 12 engages the dorsum and plantar surfaces of the user's foot centering the apparatus at the talocrural joint to enable the user to perform talocrural joint movements without the apparatus disengaging from the user's foot during resistance exercise as depicted in FIGS. 5 and 7.

Figure 6:
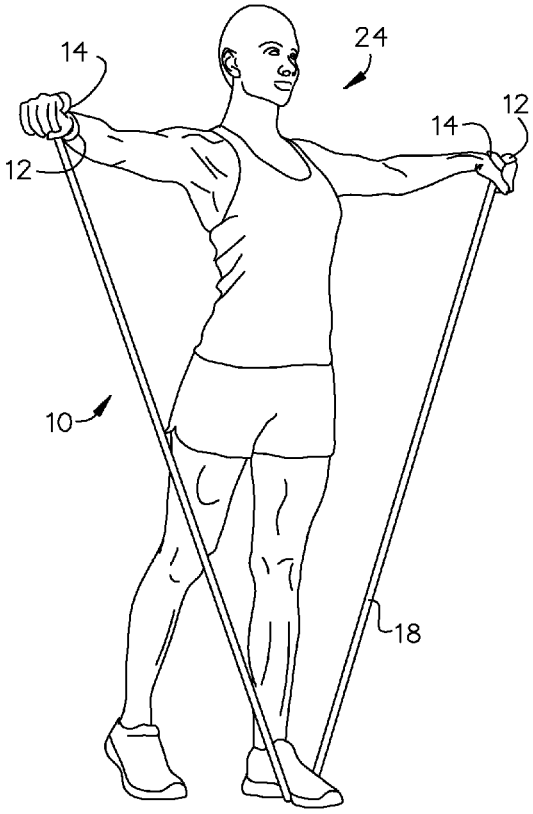
FIG. 6 is a perspective view of one embodiment of the invention in exemplary usage.

Alternatively, as depicted in FIG. 6, the primary loop 12 and auxiliary loop 14 may be gripped by the user 24 in his hands to perform arm exercises using the apparatus 10. Further, as depicted in FIG. 5 one primary loop 12 and auxiliary loop 14 may be gripped by the user 24 in his hands and the second primary loop may be secured to the user's 24 foot in order to perform full body exercises.

The elastic cord 20 may be fabricated from polyvinyl chloride tubing, thermoplastic polyurethane tubing, bungee cord, or any other elastic cord. A sheath 18 having an elasticity greater than the elastic cord 20 surrounds the elastic cord 20. The inclusion of a sheath 18 reduces the risk of injury to the user if the elastic cord 20 snaps or breaks during use, especially during functional movements, flexibility and stretching exercises.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An elastic resistance training apparatus for the performance of ankle plantar flexor resistance exercises, dorsi flexor resistance exercises, ankle inverter resistance exercises, or ankle everter exercises by a user, the apparatus comprising:

an elastic cord with a first end attached to a first primary loop and a second end attached to a second primary loop wherein the first primary loop and the second primary loop are configured to engage the dorsum and plantar surfaces of the user's foot;

a first auxiliary loop, wrapped around the first primary loop at two first primary loop points and a second auxiliary loop wrapped around the second primary loop at two second primary loop points, directly attached to the second primary loop wherein the first auxiliary loop and the second auxiliary loop are configured to engage the user's calcaneus bone when the primary loop engages the dorsum and plantar surfaces of the user's foot centering the apparatus at the talocrural joint to enable the user to perform talocrural joint movements without the apparatus disengaging from the user's foot during resistance exercises; wherein the first primary loop, the second primary loop, the first auxiliary loop and the second auxiliary loop are made from an elastic resistance tubing.

2. The elastic resistance training apparatus of claim 1, wherein the elastic cord is surrounded by a fabric of greater elasticity to protect the user in the event the elastic cord snaps during use.

3. The elastic resistance training apparatus of claim 1, wherein the elastic resistance tubing is selected from the group consisting of polyvinyl chloride tubing, thermoplastic polyurethane tubing, and bungee cord.

4. An elastic resistance training apparatus for the performance of ankle plantar flexor resistance exercises, dorsi flexor resistance exercises, ankle inverter resistance exercises, or ankle everter exercises by a user, the apparatus comprising:

an elastic cord with a first end attached to a first primary loop and a second end attached to a second primary loop wherein the first primary loop and the second primary loop are configured to engage the dorsum and plantar surfaces of the user's foot;

a first auxiliary loop, wrapped around the first primary loop at two first primary loop points and a second auxiliary loop wrapped around the second primary loop at two second primary loop points, directly attached to the second primary loop wherein the first auxiliary loop and the second auxiliary loop are configured to engage the user's calcaneus bone when the primary loop engages the dorsum and plantar surfaces of the user's foot centering the apparatus at the talocrural joint to enable the user to perform talocrural joint movements without the apparatus disengaging from the user's foot during resistance exercises;

a first primary loop first clamp slid around the first primary loop fixing the first primary loop in a first primary loop position and flanked by a first primary loop first spacer and a first primary loop second spacer.

5. The elastic resistance training apparatus of claim 4, further comprising a first primary loop second spacer slid around the first primary loop and flanked by the first primary loop second spacer and a first primary loop third spacer.

6. The elastic resistance training apparatus of claim 5, further comprising a first primary loop covering, slid over the first primary loop first spacer, the first primary loop first clamp, the first primary loop second spacer, the first primary loop second spacer and the first primary loop third spacer.

* * * * *